US006702544B1

(12) United States Patent
Palten et al.

(10) Patent No.: US 6,702,544 B1
(45) Date of Patent: Mar. 9, 2004

(54) FRICTION VACUUM PUMP FOR USE IN A SYSTEM FOR REGULATING PRESSURE AND PRESSURE REGULATING SYSTEM COMPRISING A FRICTION VACUUM PUMP OF THIS TYPE

(75) Inventors: Thomas Palten, Kerpen (DE); Dirk Kalisch, Düsseldorf (DE)

(73) Assignee: Leybold Vakuum GmbH, Cologne (DE)

( * ) Notice: Subject to any disclaimer, the term of this patent is extended or adjusted under 35 U.S.C. 154(b) by 50 days.

(21) Appl. No.: 10/031,293

(22) PCT Filed: Jul. 11, 2000

(86) PCT No.: PCT/EP00/06571

§ 371 (c)(1),
(2), (4) Date: Jan. 14, 2002

(87) PCT Pub. No.: WO01/06129

PCT Pub. Date: Jan. 25, 2001

(30) Foreign Application Priority Data

Jul. 16, 1999 (DE) ..... 199 33 332

(51) Int. Cl.[7] ..... F04D 19/04
(52) U.S. Cl. ..... 415/1; 415/90; 415/143
(58) Field of Search ..... 415/90, 143–149.2, 415/181, 182.1, 198.1, 199.4, 199.5; 417/423.4

(56) References Cited

U.S. PATENT DOCUMENTS 4,826,394 A 5/1989 Lotz ..... 415/72
5,611,660 A * 3/1997 Wong et al. ..... 415/90
5,707,213 A 1/1998 Conrad ..... 417/53
5,944,049 A 8/1999 Beyer et al. ..... 137/487.5

FOREIGN PATENT DOCUMENTS

| | | | |
|---|---|---|---|
| DE | 30 01 134 | 7/1980 | |
| EP | 0 408 792 | 1/1991 | |
| EP | 0 643 227 | 3/1995 | |
| GB | 2189295 | 10/1987 | |
| JP | 03237297 | 10/1991 | |
| JP | 06074187 A * | 3/1994 | ..... F04D/19/04 |
| JP | 08284877 | 10/1996 | |
| RU | SU 1 707 257 | 10/1991 | |
| WO | WO 99/04325 | 1/1999 | |

* cited by examiner

*Primary Examiner*—Edward K. Look
*Assistant Examiner*—Richard A. Edgar
(74) *Attorney, Agent, or Firm*—Fay, Sharpe, Fagan, Minnich & McKee, LLP

(57) ABSTRACT

A friction vacuum pump for use in a system for regulating the pressure in a vacuum chamber includes a multistage turbomolecular vacuum pump section (6) whose stages each consist of a row of stator vanes and rotor vanes (14 or 13). The pump regulates the pressure of heavy gases or of a gas mixture containing heavy gases. To this end, the friction vacuum pump (1) is equipped with a molecular pump section (11) located on the fore-vacuum side and a space (21, 22, 23), in which the pump action is interrupted. The space is provided in the transition area from the turbomolecular vacuum pump section (6) to the molecular pump section (11) or in the transition area from the molecular flow to viscous flow.

9 Claims, 3 Drawing Sheets

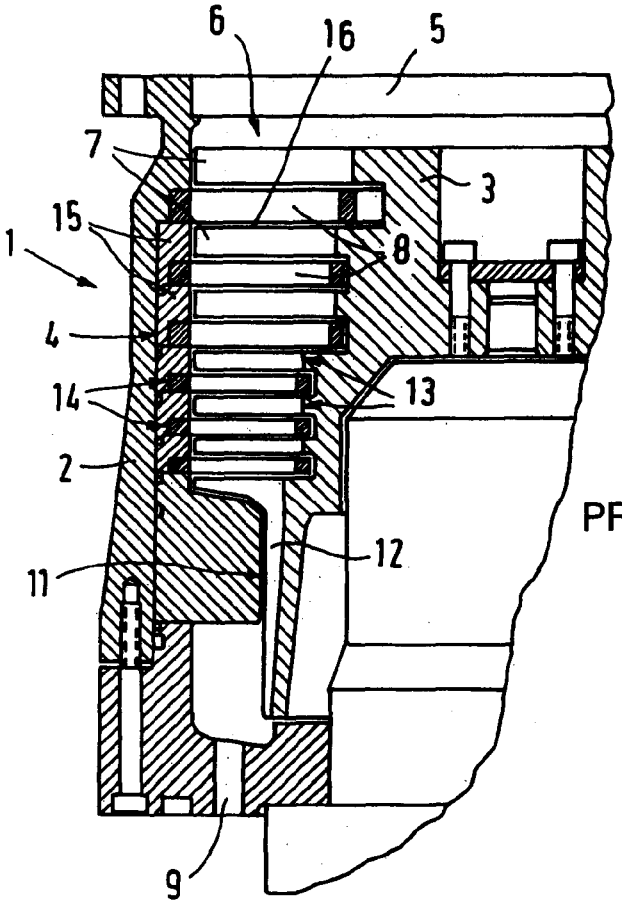
FIG.1
PRIOR ART
FIG.2
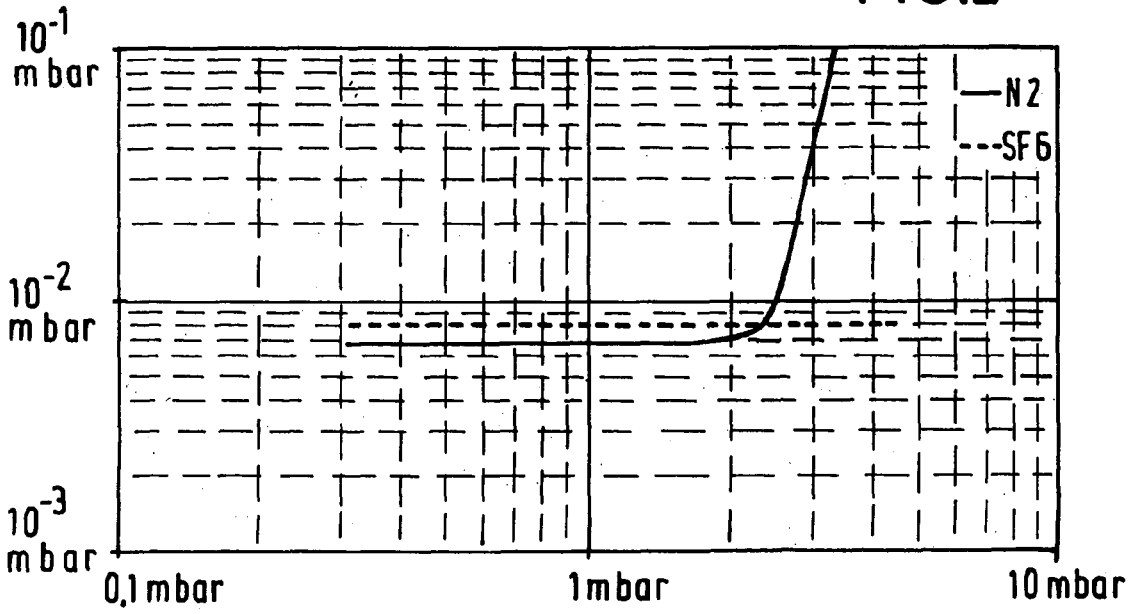
PRIOR ART

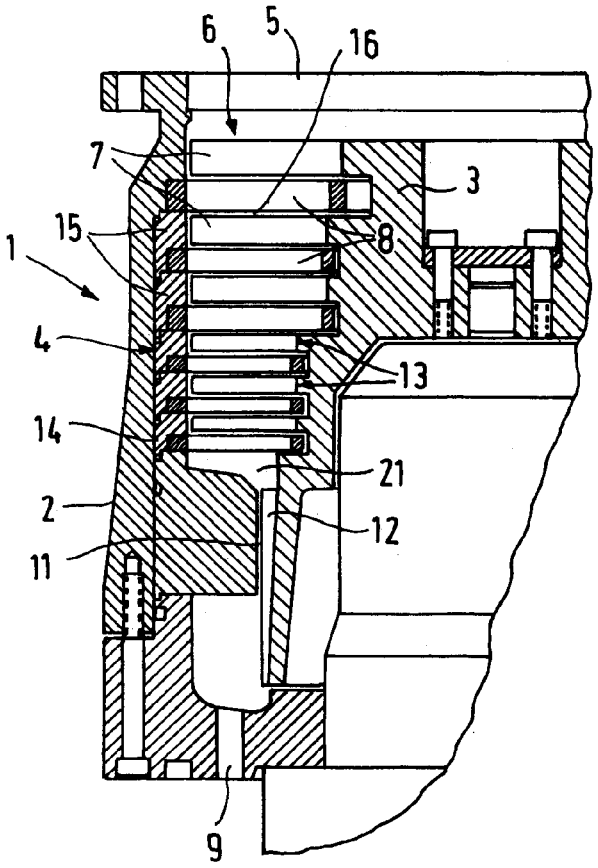
FIG. 3
FIG. 4
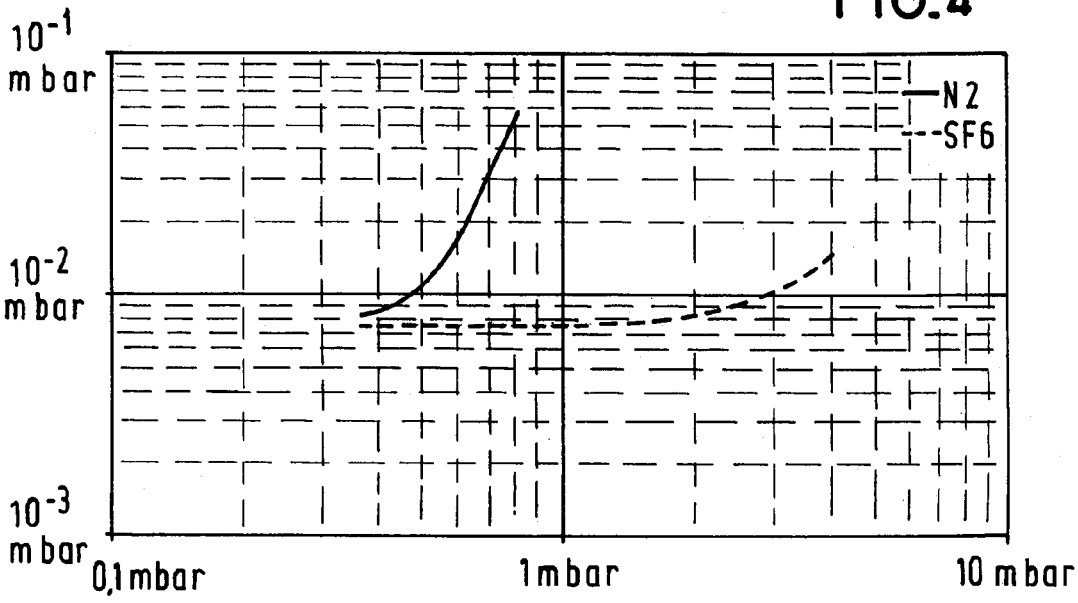

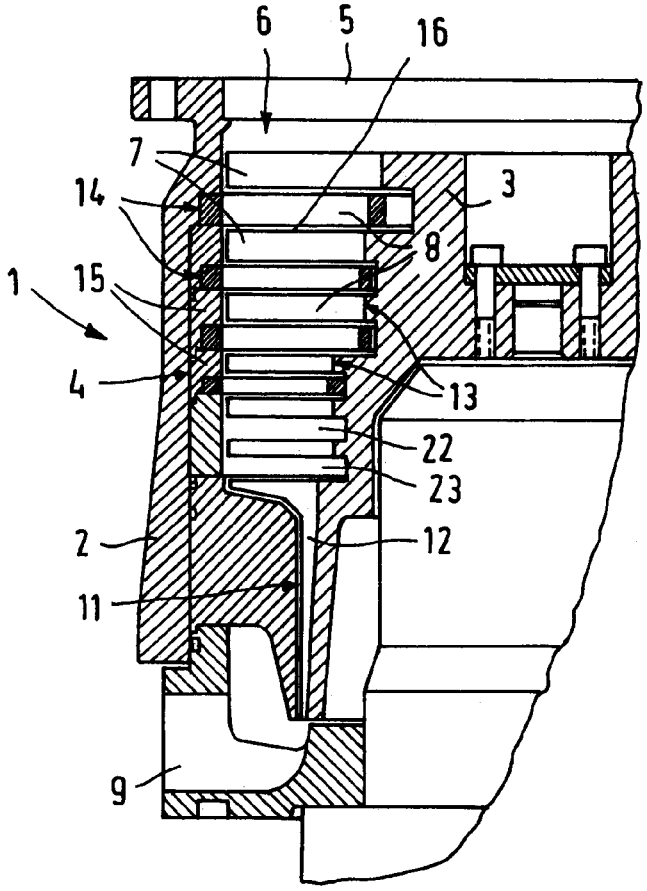
FIG.5
FIG.6
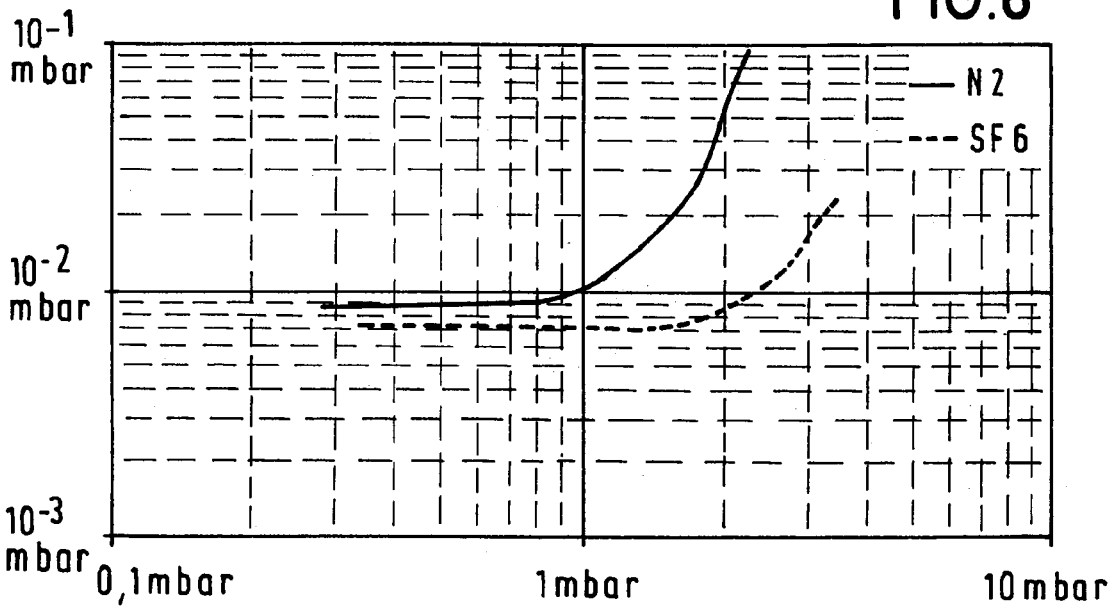

FRICTION VACUUM PUMP FOR USE IN A SYSTEM FOR REGULATING PRESSURE AND PRESSURE REGULATING SYSTEM COMPRISING A FRICTION VACUUM PUMP OF THIS TYPE

BACKGROUND OF THE INVENTION

The present invention relates to a friction vacuum pump for use in a system for regulating the pressure in a vacuum chamber comprising a multistage turbomolecular vacuum pump section whose stages each consist of a row of stator vanes and rotor vanes.

In the pressure regulating system described in U.S. Pat. No. 5,944,049, a friction vacuum pump of this type is employed. The pressure regulating facility described in said patent relies on the principle that the pressure in the vacuum chamber, i.e., on the high vacuum side of the friction pump is, within a specific pressure range, dependent on the pressure on the fore-vacuum side of the friction pump. Pressure regulation is effected in such a manner that in the instance of a pressure in the vacuum chamber deviating from the setpoint pressure, the fore-vacuum pressure for the friction vacuum pump is changed in such a manner that the pressure in the vacuum chamber is returned back to its setpoint pressure once again.

The known pressure regulating process is disadvantageous in that the pressure created by the friction vacuum pump is dependent on the type of gas, meaning that the pressure regulating process implemented thereby is also dependent on the type of gas. This shall be explained with reference to drawing FIGS. 1 and 2. Depicted in drawing FIG. 1 is a partial section through a friction vacuum pump 1, as being employed in the pressure regulating process detailed in U.S. Pat. No. 5,944,049. Pump 1 comprises a housing 2, in which a rotor 3 and a stator 4 are accommodated. For the purpose of producing a gas supply, a turbomolecular pump section 6 with rotor vanes 7 and stator vanes 8 as the active pumping elements is provided on the high vacuum side (inlet 5), and on the fore-vacuum side (discharge 9) a molecular pump section 11 designed as a Holweck pump is provided. The active pumping elements of a Holweck pump 11 consist of a single or multi-turn thread 12 arranged on the stator or the rotor side. In the design example depicted, the schematically depicted thread 12 is located at the side of the rotor 5. The active pumping elements (vanes 7, 8, thread 12) form the pump chamber 16 located between rotor 3 and stator 4, said pumping chamber extending from the first row of rotor vanes 13 to the end of thread 12 on the fore-vacuum side.

Friction pumps of the kind detailed and depicted in drawing FIG. 1 are penetrating the market more and more owing to their fore-vacuum tolerance. With the transition from the turbomolecular pump section 6 to the molecular pump section 11, the flow characteristics for the gasses being pumped also change. The initially molecular flow changes in to a viscous flow.

Turbomolecular pump section 6 is of a multistage design. Each stage comprises one each row of rotor vanes 13 and a row of stator vanes 14. The rotor 3 carries the row of rotor vanes 13. The stator 4 consists of rows of stator vanes 14 and spacing rings 15 arranged in alternating fashion over each other, said distance rings being centered by housing 2.

Rotor 3 is bell-shaped. Details as to the bearing and drive arrangement are known and not depicted in detail.

In the design example depicted in drawing FIG. 1, the cross section of the pumping area of pump 1 reduces from the high vacuum to the fore-vacuum side. This is attained in turbomolecular pump section 6 by reducing the radial length of the vanes 7, 8, and in the molecular pump section 11 by decreasing the height of the ridge of thread 12.

From the diagram of drawing FIG. 2, the regulating properties of the pump 1 in accordance with drawing FIG. 1 are apparent. Plotted on the abscissa is the fore-vacuum pressure, and on the ordinate the high vacuum pressure of the friction vacuum pump each according to a logarithmic scale. The solid curve applies to that instance where only nitrogen is present in the vacuum chamber. Within the fore-vacuum pressure range of approximately 2 to 4 mbar there is a strong dependence of the high vacuum pressure on the fore-vacuum pressure. The desired high vacuum pressure regulation is easily possible within this range.

The dashed line depicted in drawing FIG. 2 applies to that instance where only the heavier gas $SF_6$ is present in the vacuum chamber. There is hardly any dependence of the high vacuum pressure on the fore-vacuum pressure. The friction vacuum pump 1 depicted in drawing FIG. 1 might in this instance not be employed as a pressure regulator.

SUMMARY OF THE INVENTION

It is the task of the present invention to design a friction vacuum pump of the aforementioned type so that it may also be employed in the presence of heavier gases for the purpose of regulating the pressure in a vacuum chamber.

The task is solved by the present invention through the characteristic features of the patent claims.

Surprisingly, it was found that through the measures in accordance with the present invention the dependence on the type of gas may be influenced. The measures have the effect that also in the presence of heavy gases in the vacuum chamber, there is a pressure dependence between high vacuum pressure and fore-vacuum pressure which may be utilized for pressure regulating purposes.

Further advantages and details of the present invention shall be explained with reference to drawing FIGS. 3 to 6.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

Drawing FIG. 1 is a partial section through a friction vacuum Pump,

Drawing FIG. 2 is a diagram from which the pressure regulating properties of the friction vacuum pump of drawing FIG. 1 are apparent, Drawing FIG. 3 is a friction vacuum pump according to the present invention modified with respect to the Holweck pumping stage, Drawing FIG. 4 is a diagram from which the pressure regulating properties of a friction vacuum pump modified in accordance with drawing FIG. 3 are apparent, Drawing FIG. 5 is a friction vacuum pump modified with respect to the turbomolecular pump stages and Drawing FIG. 6 is a diagram from which the regulating properties of a friction vacuum pump modified in accordance with drawing FIG. 5 are apparent.

DETAILED DESCRIPTION OF THE PREFERRED EMBODIMENTS

The design example in accordance with drawing FIG. 3 differs from the design in accordance with drawing FIG. 1 by a modification of the active pumping elements of the Holweck pump 11. The thread 12 no longer extends directly up to the last (viewed from the supply direction of the gases) row of stator vanes 14. Located between the last row of stator vanes 14 and the beginning of the thread 12, there is a partial space 21 of the pumping chamber 16 without active pumping elements. The pumping capacity of the Holweck pump 11 is no longer utilized to 100%. Depending on the type of gas, the distance between the last row of stator vanes 14 and the beginning of the thread 12 is so great that only 20 to 60% of the pumping speed of the Holweck pump 11 is effective, compared to the design in accordance with drawing FIG. 1.

The diagram in accordance with drawing FIG. 4 depicts the effect of the measure in accordance with drawing FIG. 3, for the gases nitrogen and $SF_6$ as well as a 40% utilization of the effect of the Holweck pump 11. Compared to drawing FIG. 2, the regulating range for nitrogen is shifted to the left. For $SF_6$ in the range of 1 to 5 mbar, the dependence of the pressure on the high vacuum side of friction vacuum pump 1 on the pressure at the fore-vacuum side is already so great that the pump in accordance with drawing FIG. 3 may, in this range, also be employed for regulating purposes in the instance of heavier gases.

The design example in accordance with drawing FIG. 5 differs from the design in accordance with drawing FIG. 1, in that the two rows of stator vanes 14 on the fore-vacuum side of the turbomolecular pump section 6 have been omitted. Experiments indicates that the desired effect is already apparent, if only the last row of stator vanes 14 is missing. The desired effect, however, is attained particularly well if two rows of stator vanes 14 are missing. The results of this measure are depicted in the diagram in accordance with drawing FIG. 6. For both types of gas there exists in the range from 1 to 4 mbar a significant dependence between the pressure on the fore-vacuum side and the pressure on the high vacuum side of friction vacuum pump 1, allowing for both gases the employment of the pump 1 in accordance with drawing FIG. 5 for pressure regulating purposes.

The aforementioned designs affect such instances where there is present in the vacuum chamber the internal pressure of which is to be regulated, only one type of gas. In practice, however, this is only rarely the case. As long as the share of heavy gases in the gas mixture is low, the pressure regulating process detailed in U.S. Pat. No. 5,944,049 may be successfully employed. However, it fails more and more as the share of heavier gases in the vacuum chamber increases. This deficiency can be rectified through the present invention. The gas mixtures present in the vacuum chamber are manifold and depend chiefly on the process (for example etching, evaporation coating processes in the area of semiconductor engineering) being performed in the vacuum chamber. The experiments performed have resulted in the finding that it is not possible to define the solution in accordance with the present invention (creation of a space without active pumping elements in the transitional area between turbomolecular pump section and molecular pump section or from molecular to viscous flow) for each of the many types of gas mixtures encountered in practice. The user will have to adapt empirically the design of the spaces 21, 22, 23 without active pumping elements to the type of gas mixture in each instance. He will need to perform in advance experiments, and in the course of such experiments vary the size of the active part of the Holweck pump 11 and/or the number of rows of stator and rotor vanes until he determines an optimum regulating range.

The number of active turbo stages will also depend on the desired maximum pumping capacity of the turbomolecular pump. The design examples in accordance with drawing FIGS. 1, 3, and 5 do not have a significant influence on the maximum pumping capacity. A reduction in the number of active turbo states by over two increases the regulating range for heavy gases, but at the same time reduces the maximum pumping capacity for "lighter" gases. For very heavy gases, even all rows of stator vanes may be omitted.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. A friction vacuum pump for use in a system for regulating the pressure in a vacuum chamber, comprising:

a multistage turbomolecular vacuum pump section whose stages each consist of a row of stator vanes and rotor vanes;

a molecular pump section including a Holweck pump; and a flow transitional space between the turbomolecular pump section and the Holweck pump in which molecular flow transition to viscous flow, in which space a section of thread of the Holweck pump is missing such that the pumping action is interrupted.

2. The pump according to claim 1, wherein a row of vanes on a stator side is missing.

3. The pump according to claim 2, wherein two or more rows of stator vanes on a fore-vacuum side are missing.

4. A vacuum pump comprising:

a turbomolecular pump section including a rotor, a stator, and interengaging vanes;

a Holweck pump section including a rotor, a stator, and threads, the turbomolecular pump section rotor and the Holweck pump section rotor being interconnected to rotate together and the turbomolecular pump section stator and the Holweck pump stator being interconnected;

the Holweck pump section threads shortened to define a space between the turbomolecular pump section and the Holweck pump section, the space being sized such that pumping capacity of the Holweck pump section is reduced.

5. A friction vacuum pump for use in a system for regulating the pressure in a vacuum chamber, comprising:

a multistate turbomolecular vacuum pump section whose stages consist of rows of stator vanes and rotor vanes, a row of rotor vanes on the fore-vacuum side being missing;

a molecular pump section; and a space between the turbomolecular pump section and the molecular pump section in which molecular flow transitions to viscous flow, in which space the pumping action is interrupted.

6. The pump according to claim 5, wherein the space free of pumping action is defined by an omission of active pumping elements.

7. A system for regulating pressure in a vacuum chamber with the aid of a friction vacuum pump as described in claim 5.

8. A process for regulating the pressure in a vacuum chamber containing a gas mixture with a friction vacuum pump as set forth in claim 5 further including:

by experiments, adapting a size of the space to the type of gas mixture in the vacuum chamber.

9. A method of regulating vacuum pressure comprising:

pumping gas from a vacuum chamber with a viscous flow by interaction of interengaging rotary and stationary vanes of a turbomolecular pump;

interrupting pumping action in a region in which flow transactions between the viscous flow and a molecular flow by eliminating a row of the vanes of the turbomolecular pump; and pumping gas from the flow transition region with a molecular pump.

* * * * *